US006964536B1

(12) United States Patent
Alhateeb

(10) Patent No.: US 6,964,536 B1
(45) Date of Patent: Nov. 15, 2005

(54) LOTION APPLICATOR

(76) Inventor: Hayat H. Alhateeb, P.O. Box 415, McLean, VA (US) 22101

( * ) Notice: Subject to any disclaimer, the term of this patent is extended or adjusted under 35 U.S.C. 154(b) by 0 days.

(21) Appl. No.: 11/140,207

(22) Filed: May 31, 2005

(51) Int. Cl.[7] ..... A46B 5/02; B43M 11/02
(52) U.S. Cl. ..... 401/219; 401/6; 401/208
(58) Field of Search ..... 401/6, 208, 218, 401/219, 220

(56) References Cited

U.S. PATENT DOCUMENTS

| | | | | |
|---|---|---|---|---|
| 1,000,081 A | | 8/1911 | Erwin | |
| 3,870,419 A | | 3/1975 | Sage | |
| 4,059,358 A | * | 11/1977 | Arai | 401/219 |
| 4,555,196 A | * | 11/1985 | De Garmo | 401/220 |
| 4,571,769 A | | 2/1986 | Ford | |
| D308,734 S | | 6/1990 | Makovich et al. | |
| 5,230,303 A | * | 7/1993 | Rubino | 119/603 |
| 5,419,646 A | | 5/1995 | Taylor | |
| 6,017,162 A | | 1/2000 | Call | |
| 6,123,478 A | * | 9/2000 | Giles | 401/219 |
| 6,543,954 B2 | | 4/2003 | Owings | |

* cited by examiner

*Primary Examiner*—David J. Walczak

(57) ABSTRACT

An applicator includes a receptacle that has upper and lower portions. The upper portion includes intake ports extending from a top surface thereof. Each port defines an opening at a top end thereof. The lower portion includes a spout extending therefrom. A tubular shaft has a handle portion. A bracket includes arms and a top edge bridged therebetween. The top edge is engageable with a distal end of the shaft and one intake port. The arms are forwardly offset from a vertical axis. Each arm has an aperture formed therein for receiving the rod ends. A roller is connected to the arms and spaced below the spout. A linear rod is conjoined to the roller. An insert is positioned within the receptacle and includes an adaptable spring positioned therein that is isolated from the fluids, minimizing contamination thereof. The insert is abutted against the bracket.

18 Claims, 6 Drawing Sheets

LOTION APPLICATOR

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to applicator apparatuses and, more particularly, to a lotion applicator for more easily dispensing and applying lotions and other fluids to a user's back.

2. Prior Art

Many people apply various types of lotions to the body. Sun-screen, which protects the skin from ultraviolet rays, is often applied by individuals to provide protection from this harmful radiation. Other lotions and skin creams are also applied to the body to treat a variety of ailments including, but not limited to, dryness, burns, skin diseases and other ailments. It is often difficult for a person to apply lotion to certain parts of their own body, such as their back and the posterior areas of their legs. This is especially true for those who suffer from physical ailments that limit their bending and stretching capabilities. The result is often either uneven application of the lotion or no application at all.

The use of lotion applicators is known in the prior art. More specifically, lotion applicators heretofore devised and utilized for the purpose of dispensing controlled amounts of lotion on the user's body are known to consist basically of familiar, expected, and obvious structural configurations, notwithstanding the myriad of designs encompassed by the crowded prior art which has been developed for the fulfillment of countless objectives and requirements.

Unfortunately, such lotion dispensers and applicators still have many shortcomings and problems associated therewith. For instance, many lotion dispensers rely on gravity to deliver the lotion onto an applicator head or use a siphon device built into the applicator head to pull the lotion/substance onto the applicator. Other lotion applicators apply lotion to the body in response to pressure placed on the applicator head. One prior art example shows a lotion applicator which utilizes a floating pressure plate to create positive pressure in order to deliver the lotion. Having the activation and amount of lotion disbursal reliant on either gravity or the pressure applied to the applicator by the body is problematic. The result of using such prior art devices is often an uneven and/or difficult to control application of the lotion.

Furthermore, although the prior art examples provide a convenient way to reach one's back and other hard-to-reach areas, they do not provide an easy way to visualize the actual application process. Thus, a user still can not see whether they have evenly and completely applied the lotion to their skin. This effectively defeats the purpose of the lotion applicator.

Accordingly, a need remains for a lotion applicator in order to overcome the above-noted shortcomings. The present invention satisfies such a need by providing a lotion applicator that is easy and convenient to use, durable in design, has an attractive and practical design, and reduces user frustration and effort. Such a lotion applicator effectively and easily applies lotion to hard-to-reach areas of the body with ease and minimal effort. The mirror attachment provides a convenient way to view the intended area of application as one is applying lotion thereto, thus ensuring an even and thorough application. The lotion applicator is appreciable by a various individuals since same can be used to apply sun tan lotions, therapeutic oils, medical ointments, etc.

BRIEF SUMMARY OF THE INVENTION

In view of the foregoing background, it is therefore an object of the present invention to provide a lotion applicator. These and other objects, features, and advantages of the invention are provided by a lotion applicator for dispensing and applying lotions and other fluids to a user's back.

The applicator includes a receptacle for effectively and conveniently housing fluids therein. Such a receptacle has monolithically formed upper and lower portions. The upper portion includes a plurality of intake ports extending vertically from a top surface thereof. Such intake ports each define a threaded opening formed at a top end thereof and extending upwardly from the upper portion. The opening of one intake portion has a diameter greater than the opening of another intake portion. The lower portion converges downwardly from the upper portion and includes a monolithically formed spout extending downwardly away therefrom such that the fluids are effectively channeled towards a center of the lower portion. The inlet ports and the spout preferably each include a cap threadably engageable therewith for advantageously and effectively preventing fluid from undesirably entering or exiting the receptacle respectively.

A rectilinear and elongated tubular shaft has a monolithically formed handle portion. Such a handle portion preferably includes an actuating member medially disposed therein. The actuating member is selectively adaptable between raised and lowered positions in such a manner that the actuating member remains nested within the handle portion and oriented orthogonal to the longitudinal axis.

Such an actuating member includes a rectilinear and elongated solid shaft that has proximal and distal end portions. The proximal end portion of the solid shaft is directly conjoined to the handle and extends orthogonal and axially therefrom through the tubular shaft. The distal end portion of the solid shaft includes a monolithically formed plug adaptable between open and closed positions. The distal end portion of the solid shaft and the plug extends axially through the insert and confronts a top end of the spring member. Such a spring member is effectively biased to the compressed position when the actuating member is biased to the lowered position.

The plug is adaptable to the open position when the actuating member is biased to the lowered position. The spring member is biased to the compressed position when the plug is biased to the open position. Such a plug is adaptable to the closed position when the actuating member is biased to the raised position and the spring member is biased to the decompressed position. Fluid contained in the receptacle is effectively caused to exit the receptacle downwardly toward the roller via the spout when the actuating member is biased to the lowered position.

A bracket includes a plurality of spaced arms and a monolithically formed top edge directly bridged therebetween. Such a top edge is threadably engageable with a distal end of the tubular shaft and one of the intake ports of the receptacle such that the tubular shaft advantageously becomes securely conjoined to the bracket and the receptacle respectively. The arms are forwardly offset from a vertical axis, wherein each arm has an aperture formed therein for effectively receiving axially opposed end portions of the rod respectively.

A roller is directly and rotatably connected to the arms and spaced below the spout in such a manner that fluid exiting the lower portion of the receptacle lands directly onto a target zone of the roller during operating conditions. Such a target zone is defined along one-half a surface area of the roller such that the fluids advantageously do not prematurely and undesirably ooze away from the target zone during operating conditions. A continuous and linear rod is directly conjoined to the roller such that the roller is journaled thereabout.

An insert is positioned within the receptacle and extends downwardly therefrom along a vertically registered longitudinal axis. Such an insert includes a deformably resistant spring member medially positioned therein and selectively adaptable between compressed and decompressed positions. The spring member is isolated from the fluids for advantageously and effectively minimizing undesirable contamination thereof. The insert is maintained within the upper portion of the receptacle and is directly abutted against the bracket. The applicator may further include a funnel for conveniently assisting a user to add fluid to the receptacle.

In an alternate embodiment, the applicator may further include a mirror removably attachable directly to the tubular shaft. Such a mirror is conveniently adaptable along a length of the tubular shaft such that the user can selectively adjust the position of the mirror when engaging the roller along the user's back.

In yet another embodiment, the tubular shaft may further include a detachable auxiliary shaft that has opposed end portions directly and threadably engageable with the distal end of the tube and the top edge of the bracket respectively such that a longitudinal length of the tubular shaft can conveniently and advantageously be adjusted to accommodate users of varying height.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
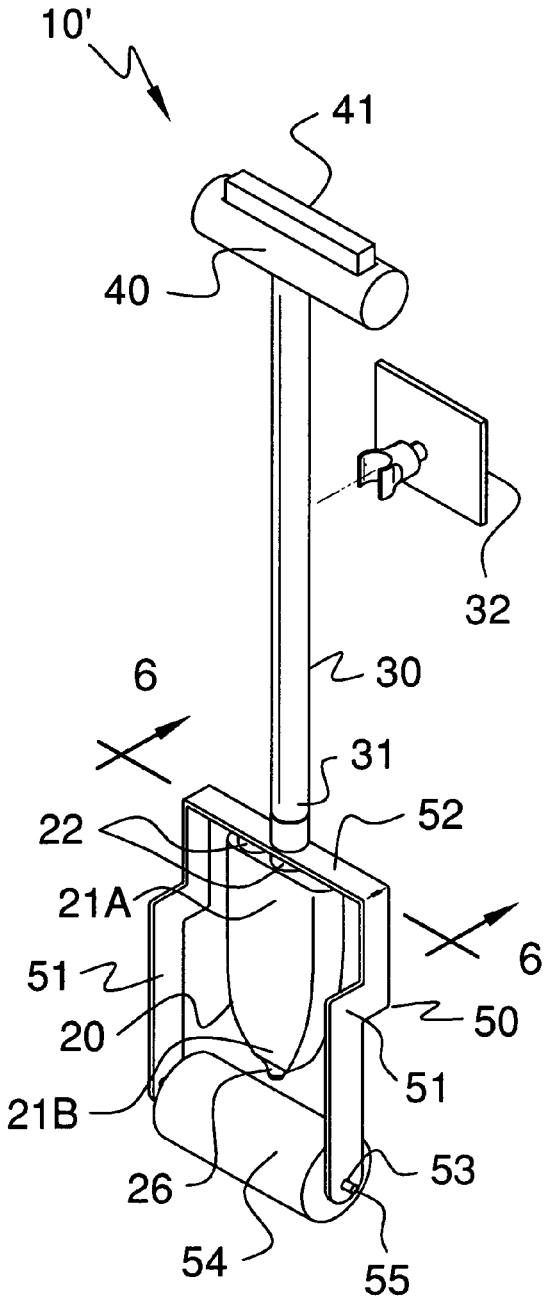
FIG. 1 is a perspective view showing an alternate embodiment of the lotion applicator, in accordance with the present invention.
Figure 2:
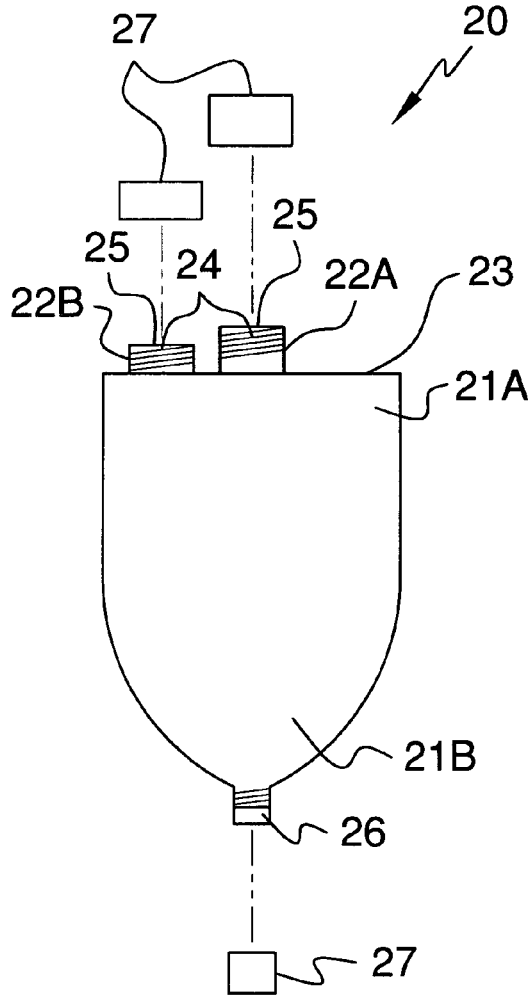
FIG. 2 is an enlarged front-elevational view of the receptacle shown in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to alternate embodiments of such elements.

The apparatus of this invention is referred to generally in FIGS. 1–8 by the reference numeral 10 and is intended to provide a lotion applicator. It should be understood that the apparatus 10 may be used to apply many different types of fluids and should not be limited in use to only applying sun tanning lotion.

Referring initially to FIGS. 1, 2, 3, 5, 7 and 8, the apparatus 10 includes a receptacle 20 for effectively and conveniently housing fluids 11 therein. Of course, the receptacle 20 may house various types of fluids therein including, but not limited to, sun tan lotions, therapeutic oils and medicated ointments, as is obvious to a person of ordinary skill in the art. Furthermore, the receptacle 20 may be produced in a variety of different shapes sizes and colors, as is obvious to a person of ordinary skill in the art. Such a receptacle 20 has monolithically formed upper 21A and lower 21B portions.

The upper portion 21A includes a plurality of intake ports 22 extending vertically from a top surface 23 thereof. Such intake ports 22 each define a threaded opening 24 formed at a top end 25 thereof and extending upwardly from the upper portion 21A. The opening 24 of one intake portion 22A has a diameter greater than the opening 24 of another intake portion 22B. The lower portion 21B converges downwardly from the upper portion 21A and includes a monolithically formed spout 26 extending downwardly away therefrom, which is essential such that the fluids 11 are effectively channeled towards a center of the lower portion 21B. The inlet ports 24 and the spout 26 each include a cap 27 threadably engageable therewith that is advantageous and crucial for effectively preventing fluid 11 from undesirably entering or exiting the receptacle 20 respectively. This feature advantageously saves the user a considerable amount of money that would otherwise be spent on replacing lost and unused fluid 11 that leaked from the receptacle 20.

Referring to FIGS. 1, 3, 4 and 8, a rectilinear and elongated tubular shaft 30 has a monolithically formed handle portion 40. Such a handle portion 40 includes an actuating member 41 medially disposed therein. The actuating member 41 is selectively adaptable between raised and lowered positions in such a manner that the actuating member 41 remains nested within the handle portion 40 and oriented orthogonal to the longitudinal axis. The handle 40, the actuating member 41 and the tubular shaft 30 in conjunction with the roller 54, (described herein below) advantageously allows a user to apply lotion to their back region without the assistance of another person.

Figure 4:
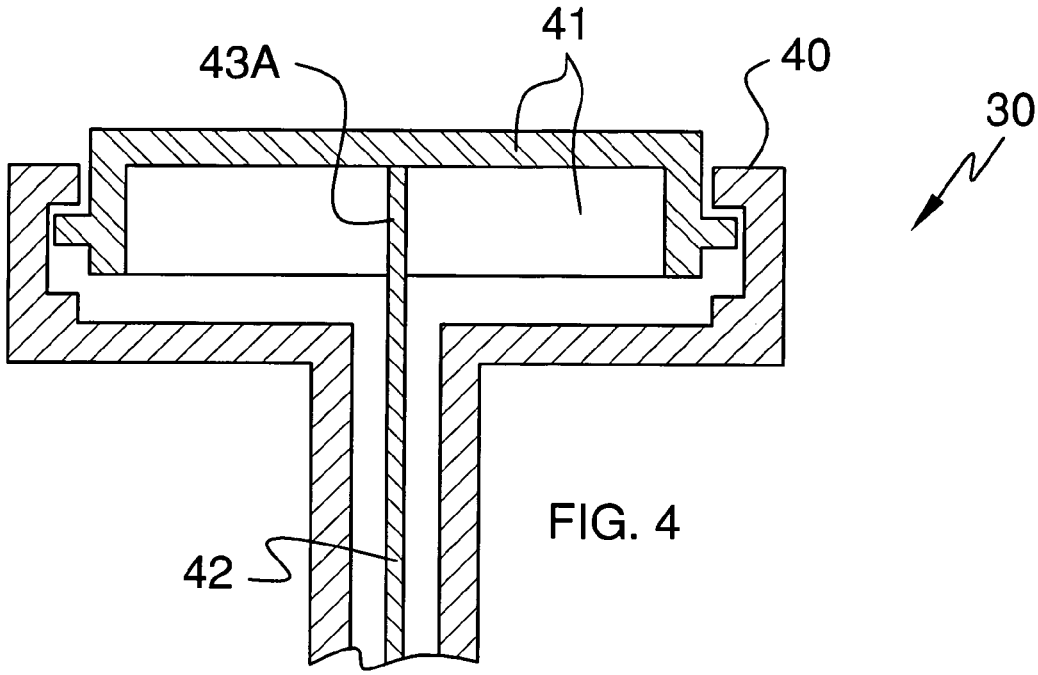
FIG. 4 is a cross-sectional view of the handle portion shown in FIG. 3, taken along line 44.
Figure 5:
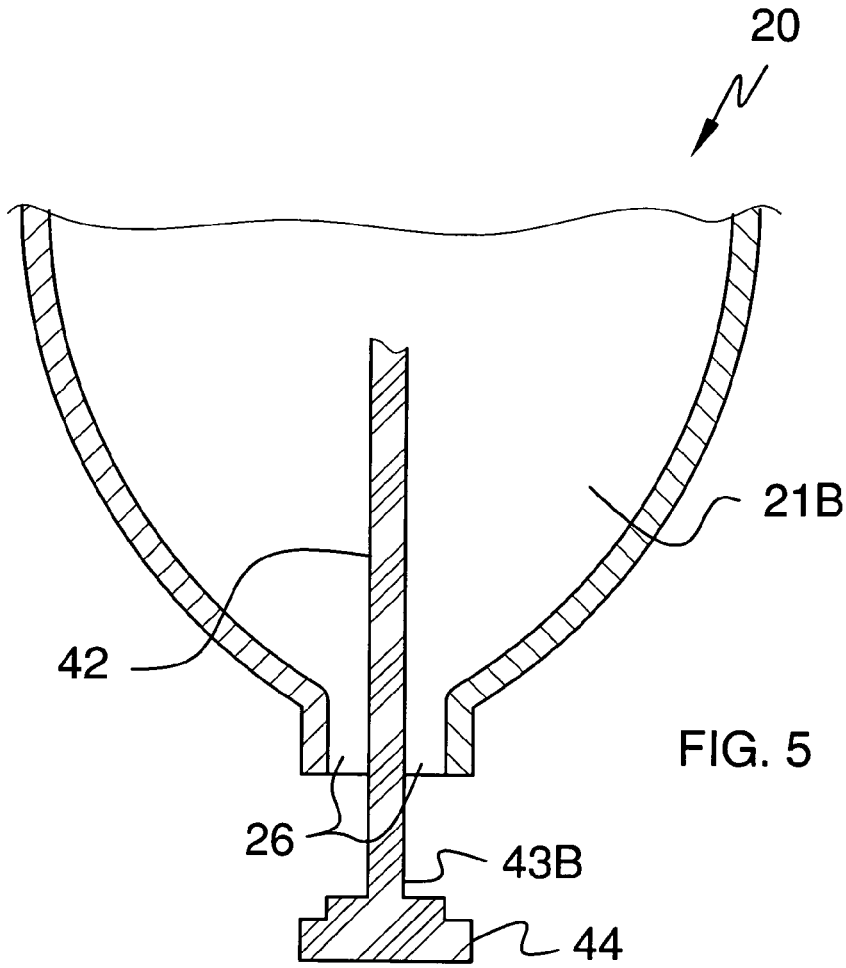
FIG. 5 is a cross-sectional view of the lower receptacle portion shown in FIG. 3, taken along line 5—5.
Figure 6:
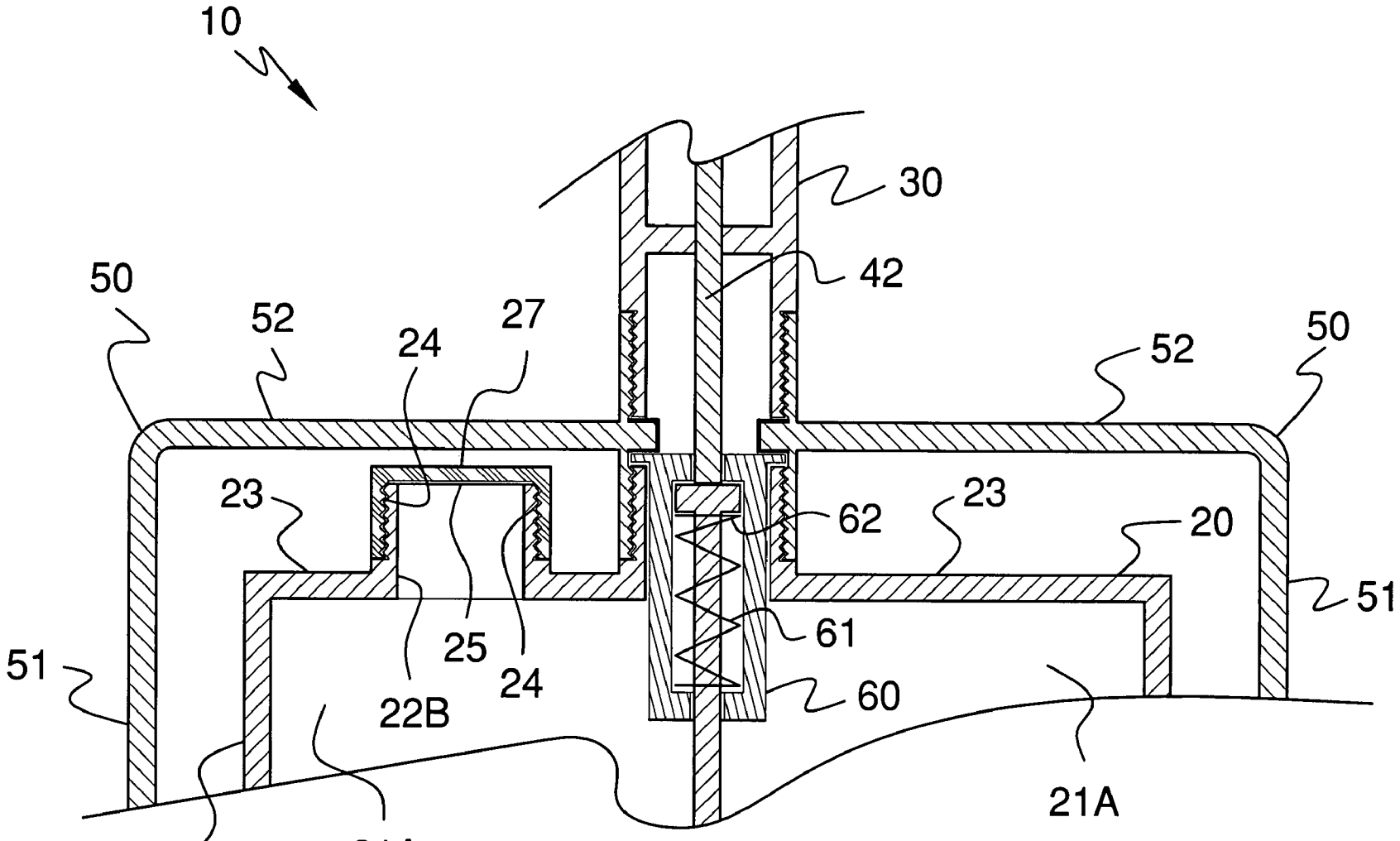
FIG. 6 is a cross-sectional view of the bracket top edge and the distal end of the tubular shaft shown in FIG. 1, taken along line 6—6.
Figure 7:
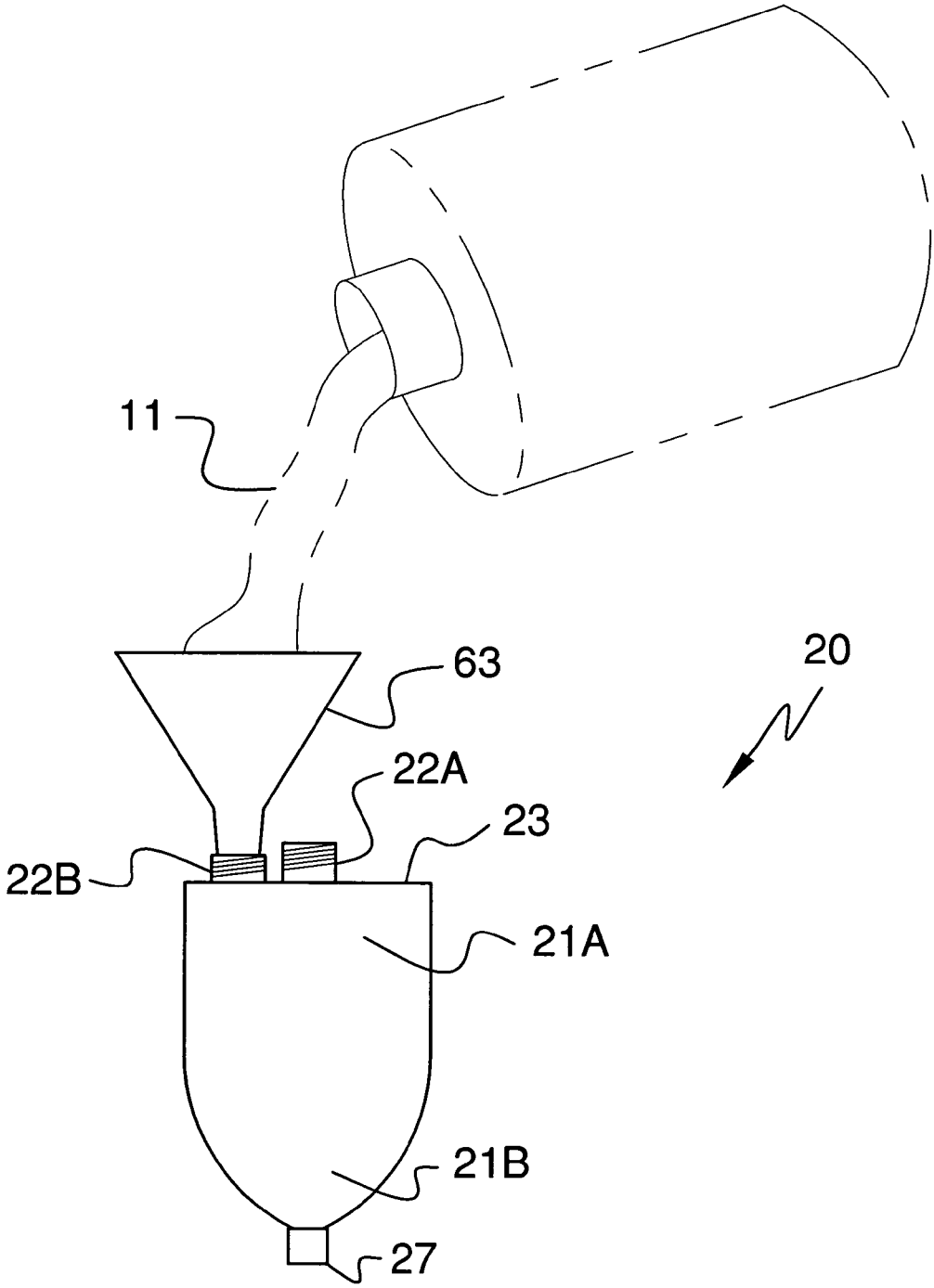
FIG. 7 is a front elevational view of the receptacle shown in FIG. 2, showing the funnel attached thereto for refilling purposes.

Referring to FIGS. 4 through 6, such an actuating member 41 includes a rectilinear and elongated solid shaft 42 that has proximal 43A and distal 43B end portions. The proximal end portion 43A of the solid shaft 42 is directly conjoined, with no intervening elements, to the handle 40 and extends orthogonal and axially therefrom through the tubular shaft 30. The distal end portion 43B of the solid shaft 42 includes a monolithically formed plug 44 that is adaptable between open and closed positions. Thus, when the plug 44 is adapted to the open position, fluid 11 can effectively exit the receptacle 20 until a desired amount has been dispensed onto the roller 54 (described herein below). The distal end portion 43B of the solid shaft 42 and the plug 44 extends axially through the insert 60 and confronts a top end 62 of the spring member 61 (described herein below).

Still referring to FIGS. 4 through 6, such a spring member 61 is effectively biased to the compressed position when the actuating member 41 is biased to the lowered position, as is shown in FIG. 6. The plug 44 is adaptable to the open position when the actuating member 41 is biased to the lowered position. The spring member 61 is biased to the compressed position when the plug 44 is biased to the open position. Such a plug 44 is adaptable to the closed position when the actuating member 41 is biased to the raised position and the spring member 61 is biased to the decompressed position. Fluid 11 contained in the receptacle 20 is effectively caused to exit the receptacle 20 downwardly toward the roller 54 via the spout 26 when the actuating member 41 is biased to the lowered position.

Referring to FIGS. 1, 3, 6 and 8, a bracket 50 includes a plurality of spaced arms 51 and a monolithically formed top edge 52 directly bridged, with no intervening elements, therebetween. Such a top edge 52 is threadably engageable with a distal end 31 of the tubular shaft 30 and one of the intake ports 22 of the receptacle 20, which is important such that the tubular shaft 30 advantageously becomes securely conjoined to the bracket 50 and the receptacle 20 respectively. The arms 51 are forwardly offset from a vertical axis, wherein each arm 51 has an aperture 53 formed therein for effectively receiving axially opposed end portions of the rod 55 (described herein below) respectively.

Figure 3:
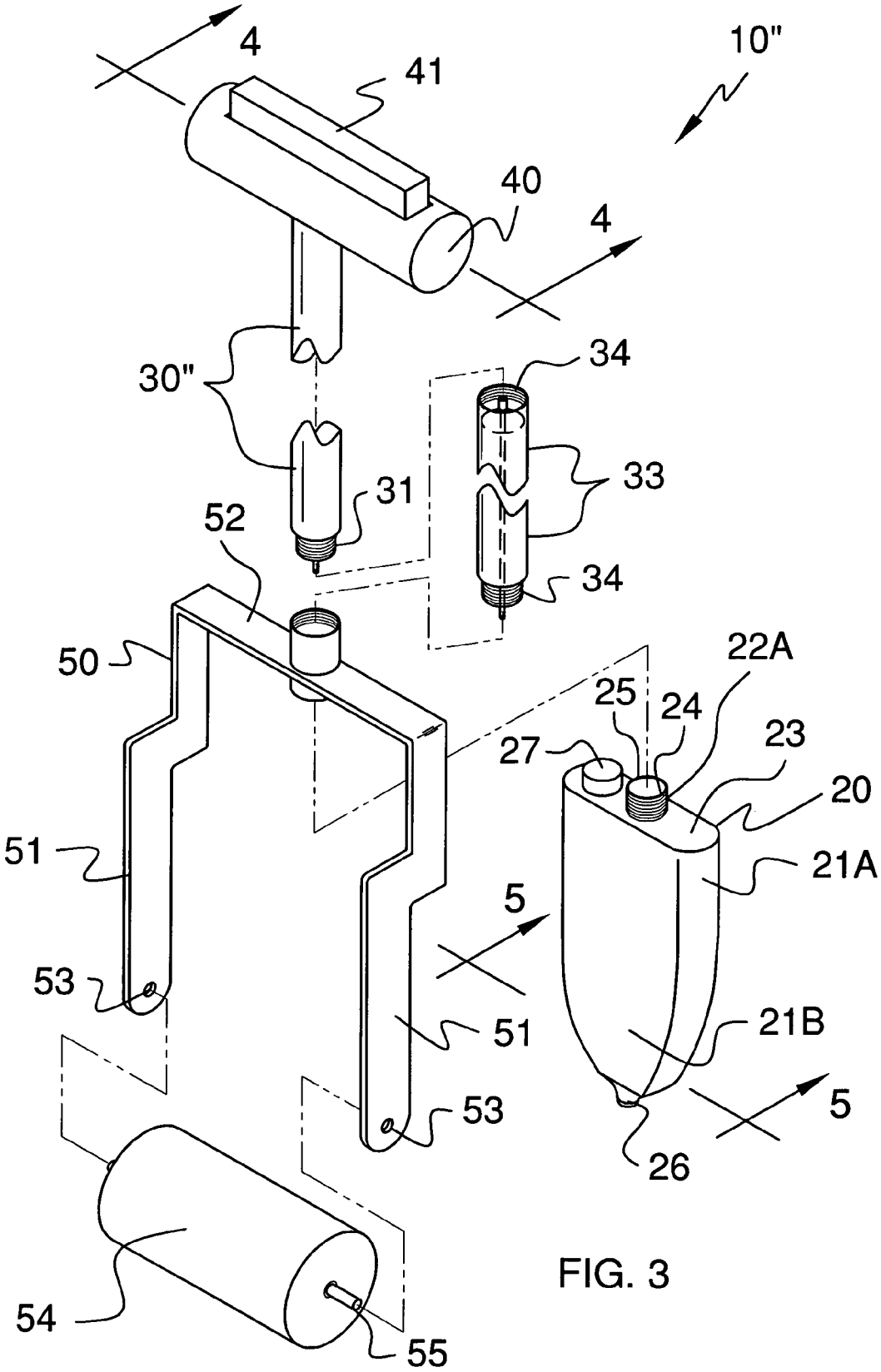
FIG. 3 is an exploded perspective view showing yet another alternate embodiment of the lotion applicator, in accordance with the present invention.
Figure 8:
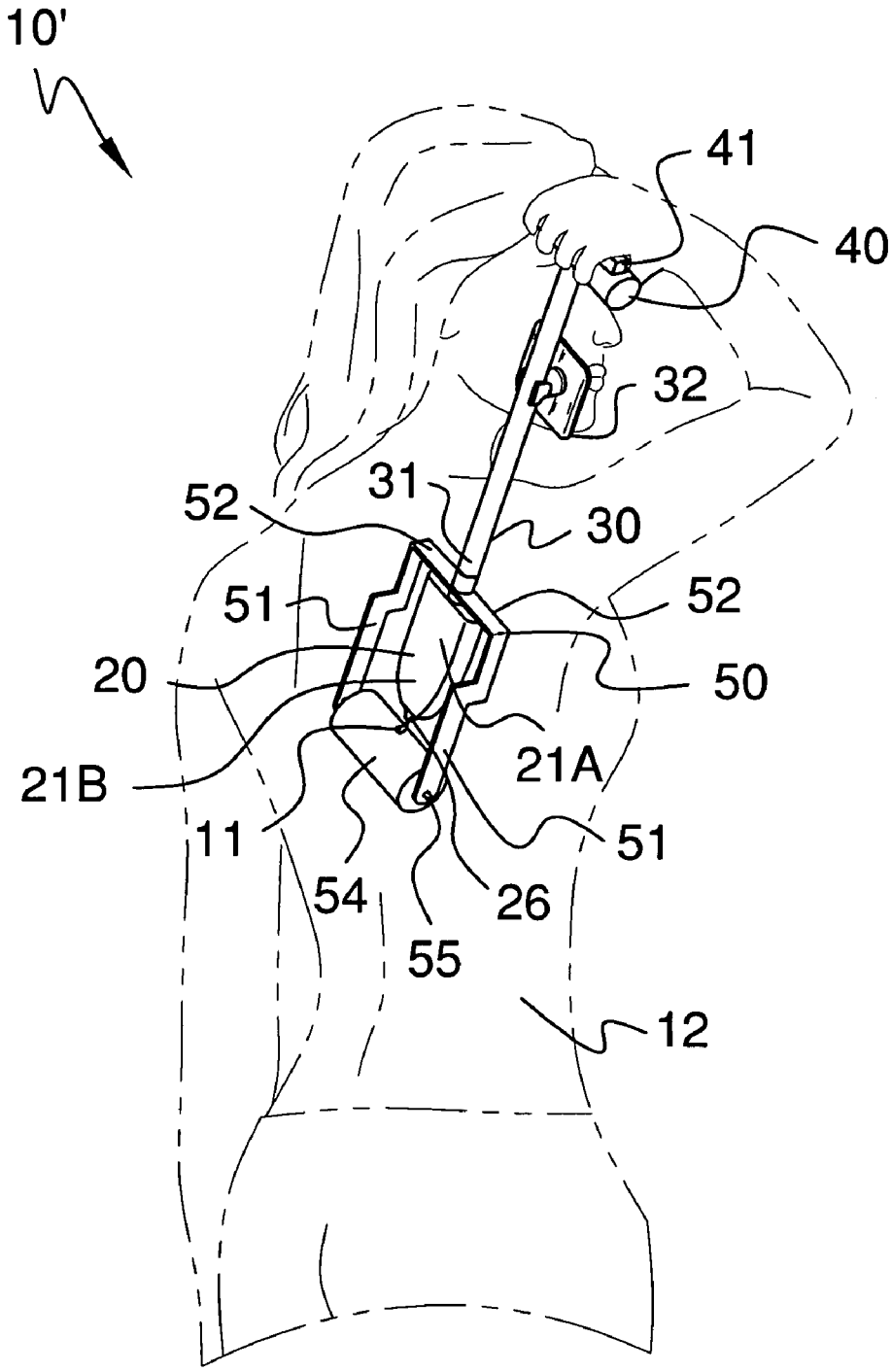
FIG. 8 is a perspective view of the apparatus alternate embodiment shown in FIG. 1, showing the apparatus during operating conditions.

Referring to FIGS. 1, 3 and 8, a roller 54 is directly and rotatably connected, with no intervening elements, to the arms 51 and spaced below the spout 26 in such a manner that is vital for allowing fluid 11 exiting the lower portion 21B of the receptacle 20 to land directly onto a target zone of the roller 54 during operating conditions. Such a target zone is defined along one-half a surface area of the roller 54, which is critical such that the fluids 11 advantageously do not prematurely and undesirably ooze away from the target zone during operating conditions. A continuous and linear rod 55 is directly conjoined, with no intervening elements, to the roller 54 such that the roller 54 is journaled thereabout. This feature advantageously allows the roller 54 to rotate freely and constantly, thus ensuring that the fluid 11 is applied thoroughly and evenly onto the desired skin surface.

Referring to FIG. 6, an insert 60 is positioned within the receptacle 20 and extends downwardly therefrom along a vertically registered longitudinal axis. Such an insert 60 includes a deformably resistant spring member 61 medially positioned therein and selectively adaptable between compressed and decompressed positions. The spring member 61 is isolated from the fluids 11, which is advantageous and essential for effectively minimizing undesirable contamination thereof. The insert 60 is maintained within the upper portion 21A of the receptacle 20 and is directly abutted, with no intervening elements, against the bracket 50. The applicator 10 further includes a funnel 63 that is important for conveniently assisting a user to add fluid 11 to the receptacle 20 in such a manner that the fluid 11 is not spilled and wasted.

Referring to FIGS. 1 and 8, in an alternate embodiment 10', the applicator 10' also includes a mirror 32 removably attachable directly, with no intervening elements, to the tubular shaft 30. Such a mirror 32 is conveniently adaptable along a length of the tubular shaft 30 such that the user can selectively adjust the position of the mirror 32 when engaging the roller along the user's back 12. The mirror 32 advantageously provides the user of the apparatus 10' with a convenient indirect line-of-sight of their back 12 so that they can see where the fluid 11 is being applied by the roller 54. Thus, the user is ensured that the lotion etc. is evenly applied along their back 12.

Referring to FIG. 3, in yet another embodiment 10", the tubular shaft 30" further includes a detachable auxiliary shaft 33 that has opposed end portions 34 directly and threadably engageable, with no intervening elements, with the distal end 31 of the shaft 30" and the top edge 52 of the bracket 50 respectively, which is essential such that a longitudinal length of the tubular shaft 30' can conveniently and advantageously be adjusted to accommodate users of varying height. This feature advantageously allows the apparatus 10 to be easily used by adults as well as children. The auxiliary shaft 33 can also advantageously be used by people with back ailments and other physical disabilities to apply lotion to their lower extremities without having to bend over.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A lotion applicator for dispensing and applying lotions and other fluids to a user's back, said applicator comprising:

a receptacle for housing fluids, said receptacle having monolithically formed upper and lower portions, said upper portion including a plurality of intake ports extending vertically from a top surface thereof, said intake ports each defining a threaded opening formed at a top end thereof and extending upwardly from said upper portion, said lower portion converging downwardly from said upper portion and including a monolithically formed spout extending away therefrom such that the fluids are channeled towards a center of said lower portion;

wherein the opening of one said intake portion has a diameter greater than the opening of another said intake portion;

a rectilinear and elongated tubular shaft having a monolithically formed handle portion;

a bracket including a plurality of spaced arms and a monolithically formed top edge directly bridged therebetween, said top edge being threadably engageable with a distal end of said tubular shaft and one said intake ports of said receptacle such that said tubular shaft becomes securely conjoined to said bracket and said receptacle respectively, said arms being forwardly offset from a vertical axis;

a roller directly and rotatably connected to said arms and spaced below said spout in such a manner that fluid exiting said lower portion of said receptacle lands directly onto a target zone of said roller during operating conditions, said target zone being defined along one-half a surface area of said roller such that the fluids do not prematurely and undesirably ooze away from said target zone during operating conditions; and an insert positioned within said receptacle and extending downwardly therefrom along a vertically registered longitudinal axis, said insert including a deformably resistant spring member medially positioned therein and selectively adaptable between compressed and decompressed positions, said spring member being isolated from the fluids for minimizing undesirable contamination thereof, said insert being maintained within said upper portion of said receptacle and directly abutted against said bracket.

2. The applicator of claim 1, wherein said applicator includes a funnel for assisting a user to add fluid to said receptacle.

3. The applicator of claim 1, wherein said handle portion includes an actuating member medially disposed therein, said actuating member being selectively adaptable between raised and lowered positions in such a manner that said actuating member remains nested within said handle portion and oriented orthogonal to the longitudinal axis, said actuating member including a rectilinear and elongated solid shaft having proximal and distal end portions, said proximal end portion of said solid shaft being directly conjoined to said handle and extending orthogonal and axially therefrom through said tubular shaft, said distal end portion of said solid shaft including a monolithically formed plug adaptable between open and closed positions, said distal end portion of said solid shaft and said plug extending axially through said insert and confronting a top end of said spring member, said spring member is biased to said compressed position when said actuating member is biased to the lowered position;

wherein said plug is adaptable to the open position when said actuating member is biased to the lowered position, said spring member being biased to the compressed position when said plug is biased to the open position, said plug being adaptable to the closed position when said actuating member is biased to the raised position and said spring member is biased to the decompressed position;

wherein fluid contained in said receptacle is caused to exit said receptacle downwardly toward said roller via said spout when said actuating member is biased to the lowered position.

4. The applicator of claim 1, wherein said inlet ports and said spout each include a cap threadably engageable therewith for preventing fluid from entering or exiting said receptacle respectively.

5. The applicator of claim 1, further comprising: a mirror removably attachable directly to said tubular shaft, said mirror being adaptable along a length of said tubular shaft such that the user can selectively adjust the position of said mirror when engaging said roller along the user's back.

6. The applicator of claim 1, wherein said tubular shaft further comprises:

a detachable auxiliary shaft having opposed end portions directly and threadably engageable with said distal end of said tube and said top edge of said bracket respectively such that a longitudinal length of said tubular shaft can be adjusted to accommodate users of varying height.

7. A lotion applicator for dispensing and applying lotions and other fluids to a user's back, said applicator comprising:

a receptacle for housing fluids, said receptacle having monolithically formed upper and lower portions, said upper portion including a plurality of intake ports extending vertically from a top surface thereof, said intake ports each defining a threaded opening formed at a top end thereof and extending upwardly from said upper portion, said lower portion converging downwardly from said upper portion and including a monolithically formed spout extending away therefrom such that the fluids are channeled towards a center of said lower portion;

wherein the opening of one said intake portion has a diameter greater than the opening of another said intake portion;

a rectilinear and elongated tubular shaft having a monolithically formed handle portion;

a bracket including a plurality of spaced arms and a monolithically formed top edge directly bridged therebetween, said top edge being threadably engageable with a distal end of said tubular shaft and one said intake ports of said receptacle such that said tubular shaft becomes securely conjoined to said bracket and said receptacle respectively, said arms being forwardly offset from a vertical axis;

a roller directly and rotatably connected to said arms and spaced below said spout in such a manner that fluid exiting said lower portion of said receptacle lands directly onto a target zone of said roller during operating conditions, said target zone being defined along one-half a surface area of said roller such that the fluids do not prematurely and undesirably ooze away from said target zone during operating conditions;

a continuous and linear rod directly conjoined to said roller such that said roller is journaled thereabout; and an insert positioned within said receptacle and extending downwardly therefrom along a vertically registered longitudinal axis, said insert including a deformably resistant spring member medially positioned therein and selectively adaptable between compressed and decompressed positions, said spring member being isolated from the fluids for minimizing undesirable contamination thereof, said insert being maintained within said upper portion of said receptacle and directly abutted against said bracket.

8. The applicator of claim 7, wherein said applicator includes a funnel for assisting a user to add fluid to said receptacle.

9. The applicator of claim 7, wherein said handle portion includes an actuating member medially disposed therein, said actuating member being selectively adaptable between raised and lowered positions in such a manner that said actuating member remains nested within said handle portion and oriented orthogonal to the longitudinal axis, said actuating member including a rectilinear and elongated solid shaft having proximal and distal end portions, said proximal end portion of said solid shaft being directly conjoined to said handle and extending orthogonal and axially therefrom through said tubular shaft, said distal end portion of said solid shaft including a monolithically formed plug adaptable between open and closed positions, said distal end portion of said solid shaft and said plug extending axially through said insert and confronting a top end of said spring member, said spring member is biased to said compressed position when said actuating member is biased to the lowered position;

wherein said plug is adaptable to the open position when said actuating member is biased to the lowered position, said spring member being biased to the compressed position when said plug is biased to the open position, said plug being adaptable to the closed position when said actuating member is biased to the raised position and said spring member is biased to the decompressed position;

wherein fluid contained in said receptacle is caused to exit said receptacle downwardly toward said roller via said spout when said actuating member is biased to the lowered position.

10. The applicator of claim 7, wherein said inlet ports and said spout each include a cap threadably engageable therewith for preventing fluid from entering or exiting said receptacle respectively.

11. The applicator of claim 7, further comprising: a mirror removably attachable directly to said tubular shaft, said mirror being adaptable along a length of said tubular shaft such that the user can selectively adjust the position of said mirror when engaging said roller along the user's back.

12. The applicator of claim 7, wherein said tubular shaft further comprises: a detachable auxiliary shaft having opposed end portions directly and threadably engageable with said distal end of said tube and said top edge of said bracket respectively such that a longitudinal length of said tubular shaft can be adjusted to accommodate users of varying height.

13. A lotion applicator for dispensing and applying lotions and other fluids to a user's back, said applicator comprising:

a receptacle for housing fluids, said receptacle having monolithically formed upper and lower portions, said upper portion including a plurality of intake ports extending vertically from a top surface thereof, said intake ports each defining a threaded opening formed at a top end thereof and extending upwardly from said upper portion, said lower portion converging downwardly from said upper portion and including a monolithically formed spout extending away therefrom such that the fluids are channeled towards a center of said lower portion;

wherein the opening of one said intake portion has a diameter greater than the opening of another said intake portion;

a rectilinear and elongated tubular shaft having a monolithically formed handle portion;

a bracket including a plurality of spaced arms and a monolithically formed top edge directly bridged therebetween, said top edge being threadably engageable with a distal end of said tubular shaft and one said intake ports of said receptacle such that said tubular shaft becomes securely conjoined to said bracket and said receptacle respectively, said arms being forwardly offset from a vertical axis, each said arms having an aperture formed therein for receiving axially opposed end portions of said rod respectively;

a roller directly and rotatably connected to said arms and spaced below said spout in such a manner that fluid exiting said lower portion of said receptacle lands directly onto a target zone of said roller during operating conditions, said target zone being defined along one-half a surface area of said roller such that the fluids do not prematurely and undesirably ooze away from said target zone during operating conditions;

a continuous and linear rod directly conjoined to said roller such that said roller is journaled thereabout; and an insert positioned within said receptacle and extending downwardly therefrom along a vertically registered longitudinal axis, said insert including a deformably resistant spring member medially positioned therein and selectively adaptable between compressed and decompressed positions, said spring member being isolated from the fluids for minimizing undesirable contamination thereof, said insert being maintained within said upper portion of said receptacle and directly abutted against said bracket.

14. The applicator of claim 13, wherein said applicator includes a funnel for assisting a user to add fluid to said receptacle.

15. The applicator of claim 13, wherein said handle portion includes an actuating member medially disposed therein, said actuating member being selectively adaptable between raised and lowered positions in such a manner that said actuating member remains nested within said handle portion and oriented orthogonal to the longitudinal axis, said actuating member including a rectilinear and elongated solid shaft having proximal and distal end portions, said proximal end portion of said solid shaft being directly conjoined to said handle and extending orthogonal and axially therefrom through said tubular shaft, said distal end portion of said solid shaft including a monolithically formed plug adaptable between open and closed positions, said distal end portion of said solid shaft and said plug extending axially through said insert and confronting a top end of said spring member, said spring member is biased to said compressed position when said actuating member is biased to the lowered position;

wherein said plug is adaptable to the open position when said actuating member is biased to the lowered position, said spring member being biased to the compressed position when said plug is biased to the open position, said plug being adaptable to the closed position when said actuating member is biased to the raised position and said spring member is biased to the decompressed position;

wherein fluid contained in said receptacle is caused to exit said receptacle downwardly toward said roller via said spout when said actuating member is biased to the lowered position.

16. The applicator of claim 13, wherein said inlet ports and said spout each include a cap threadably engageable therewith for preventing fluid from entering or exiting said receptacle respectively.

17. The applicator of claim 13, further comprising: a mirror removably attachable directly to said tubular shaft, said mirror being adaptable along a length of said tubular shaft such that the user can selectively adjust the position of said mirror when engaging said roller along the user's back.

18. The applicator of claim 13, wherein said tubular shaft further comprises: a detachable auxiliary shaft having opposed end portions directly and threadably engageable with said distal end of said tube and said top edge of said bracket respectively such that a longitudinal length of said tubular shaft can be adjusted to accommodate users of varying height.

* * * * *